US007708658B2

(12) United States Patent
McInerney

(10) Patent No.: US 7,708,658 B2
(45) Date of Patent: May 4, 2010

(54) ROTATIONAL AND RETRACTABLE GOLF PUTTING DEVICE

(76) Inventor: Michael P. McInerney, 2505 Anthem Village Dr., Suite E-567, Henderson, NV (US) 89052

( * ) Notice: Subject to any disclaimer, the term of this patent is extended or adjusted under 35 U.S.C. 154(b) by 0 days.

(21) Appl. No.: 12/239,704

(22) Filed: Sep. 26, 2008

(65) Prior Publication Data

US 2009/0088266 A1 Apr. 2, 2009

Related U.S. Application Data

(60) Provisional application No. 60/976,374, filed on Sep. 28, 2007.

(51) Int. Cl.
*A63B 57/00* (2006.01)

(52) U.S. Cl. ..... 473/407; 473/175; 33/756

(58) Field of Classification Search ..... 473/173–189; 33/755–771

See application file for complete search history.

(56) References Cited

U.S. PATENT DOCUMENTS

| | | | | | |
|---|---|---|---|---|---|
| 2,041,119 | A | * | 5/1936 | Duganne | 473/176 |
| 3,604,711 | A | * | 9/1971 | Hansburg | 473/257 |
| 3,716,201 | A | * | 2/1973 | West | 242/375.2 |
| 3,834,030 | A | * | 9/1974 | Hanson | 33/759 |
| 4,273,329 | A | * | 6/1981 | Trigg et al. | 473/407 |
| 4,344,231 | A | * | 8/1982 | Martinez | 33/1 G |
| 4,532,712 | A | * | 8/1985 | Vistain | 33/613 |
| 4,880,232 | A | * | 11/1989 | Lang | 473/176 |
| D305,306 | S | * | 1/1990 | Casiello | D10/70 |
| 4,960,278 | A | * | 10/1990 | Hainey | 473/407 |
| 5,716,286 | A | | 2/1998 | Swan | |
| 5,815,873 | A | * | 10/1998 | Jones | 15/106 |
| 5,816,928 | A | | 10/1998 | Colonna | |
| 5,873,174 | A | * | 2/1999 | Kraft | 33/758 |
| 5,897,439 | A | * | 4/1999 | Hohl et al. | 473/176 |
| 6,015,352 | A | * | 1/2000 | Leopold et al. | 473/172 |
| 6,102,817 | A | * | 8/2000 | Boswell | 473/407 |
| 6,754,974 | B2 | * | 6/2004 | Bassolino et al. | 33/759 |
| 6,785,973 | B1 | * | 9/2004 | Janssen | 33/1 N |
| 7,134,968 | B1 | | 11/2006 | Pryor | |
| D569,746 | S | * | 5/2008 | Scott | D10/70 |
| 2004/0224784 | A1 | | 11/2004 | Morelli | |
| 2005/0011081 | A1 | * | 1/2005 | Brohammer | 33/756 |
| 2005/0011082 | A1 | * | 1/2005 | Smith | 33/758 |

* cited by examiner

*Primary Examiner*—Mark S Graham
(74) *Attorney, Agent, or Firm*—Jennifer Joan Riel; Riel Law

(57) ABSTRACT

A golf putting device that comprises: (a) a rotating head that includes a retractable line, a clip that attaches the retractable line to a golf club, and a first connecting member; and (b) a base that can be inserted in a golf hole and includes a second connecting member located on top of the base. The rotating head is attached to the base by engaging the first connecting member onto the second connecting member, and the rotating head rotates on the second connecting member. In embodiments for off-hole use, the golf putting device may further include a plurality of removable legs attached to the base. The rotating head may also include a housing which encloses the retractable line. This housing includes an aperture through which the retractable line passes through. The retractable line is wrapped around a spool that includes a spring wound on an arbor.

2 Claims, 7 Drawing Sheets

ROTATIONAL AND RETRACTABLE GOLF PUTTING DEVICE

This application claims the benefit of priority under 35 U.S.C. §119 of provisional application Ser. No. 60/976,374, filed Sep. 28, 2007, the contents of which are hereby incorporated by reference.

FIELD OF THE INVENTION

The present invention generally relates to golf training devices. More particularly, the present invention relates to a golf putting device that trains the user to putt with the proper force to control the pace of the golf ball and to putt a golf ball towards the intended target.

BACKGROUND

Golf is a very popular recreational game played all over the world. Millions of individuals play golf as a leisure or social activity, many thousands play in tournaments or wager on their performance, and hundreds play professionally on the Professional Golfers' Association Tour. Golf is often the game of choice for informal business meetings and social networking. Contributing to the popularity of golf among a wide range of people is the fact that it can be played by players of many different ages, from youths to senior citizens.

While golf has been played for centuries, its popularity is currently at an all-time high. Professional golf tournaments are shown on television all over the world, where players play for record prizes in the millions of dollars. World-famous professional players such as Tiger Woods have increased the reach of golf, and more people are watching and playing golf than ever before.

While millions of people play golf, few play it very well. Golf is an inherently difficult game that frustrates countless people to a level not seen in many other sports. A proper golf swing requires a great deal of training, as various muscles of the body must perform in a synchronized, fluid, and consistent manner. Learning a proper golf swing is very difficult for the average golfer. Desperate for help in playing better and lowering their scores, countless golfers turn to professional instruction, newer and more expensive equipment, and an array of practice aids and tools designed to help golfers play better.

Of all the areas that golfers seek improvement in, perhaps the most common (and indeed the most important) is putting. Putting is a delicate skill mastered by only a tiny percentage of the world's best golfers. Putting requires confidence, muscle memory, speed and distance control of the golf ball, and proper alignment—all of which are skills lacked by the vast majority of golfers around the world.

The Game of Golf

Golf is a game played on expansive outdoor courses, wherein players use various types of clubs to strike a golf ball, with the intent of getting the ball into a hole in as few strokes (swings of the golf clubs) as possible. Players begin by placing a golf ball (a hard sphere about 1.7 inches in diameter) in a designated area called a "tee box." Depending on the distance to the hole (which may range from about 100 yards to over 500 yards), players select a suitable golf club with which to strike the ball and send it toward the hole. Golf clubs are long devices that consist of a rubberized grip, a shaft made of steel, graphite, or other suitable material, and a club face designed to strike the ball. Different clubs have varying lengths, varying shaft materials, and club faces of various shapes, sizes, and lofts (the angle at which the club face strikes the ball). Players face the ball and place both hands on the club's grip, then proceed to swing the club back (this is called the "backswing") and then down and through the golf ball (this is called the "downswing"); the impact is intended to launch the ball in the air and toward the hole. Once the ball comes to rest, players continue striking the ball with the intent of sending the ball closer to the hole with each successive shot. Once the ball comes to rest on an area near the hole known as the "green," players use a club called a "putter." The putter is a club with a flat face of no or very little loft, and is used to roll the ball into the hole.

Golf is played on courses that customarily contain 18 "holes," each of which contains a tee box, an open grassy area, various obstacles such as water, sand, or trees, and a putting green with a small (4.25 inches in diameter, and about 4 inches deep) hole placed somewhere therein. Players count the number of strokes it takes to get the ball from the tee box into the hole, and tally that score. After playing all 18 "holes," the scores are added together for a final score. Scores are often expressed as a certain amount over or under "par," which is the number of strokes it would take a very good golfer to complete all 18 holes. The "par" value for most regulation 18-hole golf courses is usually 72.

Putting

Putting is considered by many to be the most challenging part of the difficult game of golf. Putting requires exact control over both the direction and distance of the golf ball, and there is very little room for error. It requires a very precise stroke of the putter, one that is firm but not too strong, one that is delicate and accurate but not too weak, one that accelerates through the ball at the proper speed and rate of acceleration, and one that stays "on line" in both the backswing and downswing to strike the ball straight in the intended direction. It requires a smooth tempo, a straight back-and-forth stroke, and the muscle memory to repeat a true putting stroke again and again.

As many putts are made from many feet away (aiming for a hole only 4.25 inches in diameter), small errors in direction (of only a degree or two) will send the ball off course enough that it will not fall into the hole. Striking the ball too softly will not get it to the hole; striking it too hard will make it go far past the hole if the ball is off line, and even skip over the hole if the ball is on line. To make matters more difficult, most putting greens are not perfectly flat and contain various slopes that will affect the path of the ball. Putting is a very difficult skill, as the margin for error is very small. Additionally, there is no way to really "make up" for a missed putt with a better shot down the line. While a good second shot can often make up for a poor first shot, each putt a golfer misses adds another stroke to their score. Missing a couple of putts on any hole is a sure way for a golfer to record a bad score on that hole.

There are at least 14 different types of golf clubs in regular use (including the driver, woods, irons, and wedges), but the putter is used far more often than any other club. In fact, roughly half of all strokes made in a round of golf are made with the putter. Therefore, the greatest influence on scores can be obtained by improving a player's skill with the putter.

As explained above, the average 18-hole golf course has a par value of 72. In theory, 36 of these strokes should be putts, which means that players aim to have two (or fewer) putts on each hole. "Three-putting," or taking three (or more) putts to get the ball into the hole once already on the green, can drastically raise golf scores, vastly decrease the chances of making par, and often can "ruin" an otherwise good hole (or even an entire round if a player three-putts too often).

Regulation golf courses have holes with a par of 3 (in which case the hole is short enough for a player to reach the green in one stroke), 4 (in which case the hole is long enough to usually require two strokes to reach the green), and 5 (in which case the hole is very long, usually requiring three strokes for an average golfer to reach the green). In all cases, players reaching the green in the expected number of strokes would have two putting strokes in order to get the ball in the hole and still score par on that hole. Clearly, a player that three-putts a hole is at a tremendous disadvantage: for example, the player no longer has any chance at all of a par on a par-3 hole.

The most common cause of three-putting is lack of proper distance control when putting. In other words, lack of proper pace and acceleration when striking the ball. A pace that is too slow, or that does not follow through properly, will result in a ball that does not reach the hole. On the other hand, a stroke that is too strong can cause the ball to roll well past the hole, sometimes off the green altogether and even further from the hole than it started! Such disastrous putts can quickly escalate a player's score for the round.

Many players suffer from poor putting strokes. One very common problem is a lack of follow-through: players poke or "stab" at the ball, striking it with the club and then immediately stopping the club's forward motion. This rapid deceleration at the point of impact makes it difficult to strike the ball with the desired force. It also leads to a very poor roll or spin on the ball, which decreases accuracy. Golf experts recommend instead a consistent acceleration through the ball, which includes a follow-through after the ball is struck. The pace of this acceleration is obviously slower for short putts and faster for longer ones, but a consistent acceleration is far easier to control than an acceleration followed by an abrupt deceleration of the putter. Players who decelerate the club head when putting often decelerate too quickly, causing them to barely hit the ball and leave it short, or too slowly, causing the ball to travel too far. Both of these errors often lead to three-putts.

Golf Aids

Golf is a game that is very popular, is often played in groups, and is often played competitively for money; yet the game is very difficult for most people. Most (if not all) players are constantly practicing, reading articles, paying for golf lessons from professionals, and generally trying to improve their golf game and lower their scores. Thus, there is a large market for various types of training aids, specialized equipment, and swing aids to help the average golfer play better. Examples of aids include nets to strike balls into, holes to putt balls into, clubs that are designed to impart the "perfect swing," and various (often bulky) devices that are staked into the putting surface. However, the average golfer is still a consistently poor putter, and no putting aid on the market today adequately addresses all the necessary skills (e.g., speed and distance control of the golf ball, consistent pace, proper follow-through, proper alignment, and muscle memory of these motions) to make golfers into considerably better putters.

Drawbacks and Potential Improvements

While several golf aids (and specifically, putting aids) do exist on the market, none provide the golfer with the training necessary to meaningfully improve their putting. Most golf training aids on the market today fail to help impart muscle memory, which is acquired through repetition of a consistent movement. Muscle memory is critical in golf swings, including putting, because several different muscle groups must work in harmony, and with the proper timing and amount of strength and force. A golf swing must be fluid, with the proper muscles working in harmony, and it must be repeatable—in other words, a golfer must be able to instinctually strike a ball with a consistent amount of force by using a consistent swing speed and rate of acceleration through the ball. Many golf aids on the market today do not impart a consistent swing motion, which is necessary in order to develop muscle memory for a proper golf swing. Indeed, many golf training devices on the market focus solely on visual training for alignment, without training the vital muscle memory aspect of the golfer's swing.

Additionally, most existing putting aids focus only on either direction or speed, but not both. There is a need in the art for an improved putting aid that is designed to teach proper putter speed and acceleration and to teach a proper and straight putting stroke that stays on line with the hole. Further, there is a need for a putting aid that is able to impart the proper muscle memory by not only "guiding" the putter into the proper swing path, but by also providing tactile feedback that teaches the golfer the proper swing speed and rate of acceleration. A golf aid that performs all of these functions will result in a consistent swing (in both direction and speed), and repetition of this proper swing will train the muscles to repeat this swing again and again, eventually developing a muscle memory that will allow the golfer to recreate the proper swing even without the golf aid.

Specifically, there is a need in the art for a putting device that can train golfers to putt by using a consistent rate of acceleration through the golf ball. Many players "chop" or "hack" at the ball, slowing or stopping the putter as it makes contact with the ball. A device that encourages consistent acceleration and follow-through past the point of impact with the ball would greatly increase putting skill, and reduce the number of putts that are much too short or too long, which often lead to three-putts. Ideally, such a device would provide tactile feedback that encouraged golfers to continue the forward motion of the putter and follow through after striking the ball. This tactile feedback, repeated several times, would help to develop the critical muscle memory that is so necessary for skilled putting.

Furthermore, many of the existing training devices suffer from critical limitations. For instance, many of the devices in the art utilize one or more stakes (or similar structures) to anchor the training device into the putting surface. Such methods of attachments severely limit the golfer's putting position, and the golfer would have to suffer the inconvenience of re-staking and re-assembling the training device if the golfer desired to putt from a different position or angle with respect to the golf hole. Also, the use of stakes as a means for attachment can damage the putting surface and will limit the type of surface with which the device can be used (e.g., the device cannot be used with indoor, home, or office putting surfaces as such surfaces are not penetrable).

Many of the existing training devices are simply not practical and easily transportable since many are large and bulky, difficult to assemble, and are primarily intended for use at one location. For instance, some devices are sufficiently weighted (or in other words, heavy) to anchor to a putting surface while other devices require the use of a two or more bulky posts/stakes that must be painstakingly and strategically positioned at each putting position. Many of these devices often use strings or cords which merely provide visual training and feedback to teach alignment and fail to provide tactile feedback that teaches the golfer the proper swing speed and rate of acceleration by training the golfer's muscles. In addition, a number of golf training aids in the art do not provide actual training with an actual golf club, golf hole, and golf ball, but rather, such aides provide simulated training methods with simulated or 'practice' golf clubs, golf holes, and/or golf balls. Such training devices do not improve a golfer's real-world skills as using a simulated item will obviously provide a different "feel" for the golfer.

A putting aid that addresses all of the above drawbacks in the art would certainly be more effective in improving the putting ability of most golfers. Such a putting aid would be likely to increase the popularity of golf even further, enable more people to play better golf, reduce the frustration of many golfers, and would likely be immensely popular with golfers all over the world. Other advantages of the present invention will be apparent to one of ordinary skill in the art in light of the ensuing description of the present invention.

SUMMARY

The present invention is directed to a golf putting device and method that trains a golfer to control the distance the golf ball travels by training the golfer's muscles to understand the required force needed to control the pace of the putting swing and the proper acceleration through the golf ball on a particular surface. The present invention trains the golfer to strike a ball with a consistent amount of force by using a consistent swing speed and rate of acceleration through the ball. In addition to imparting proper muscle memory by providing tactile feedback that teaches the golfer the proper swing speed and rate of acceleration, the present invention also teaches direction, training the golfer to aim the ball towards the hole by "guiding" the putter into the proper swing path. The present invention also trains golfers to accelerate their putting stroke through the ball, resulting in the proper follow-through.

Moreover, the putting device of the present invention is versatile as it permits putting from a variety of positions—the golfer may putt from any angle around a golf hole since the putting device rotates 360 degrees, and the putting device permits putting from a variety of distances from the golf hole. The putting device of the present invention is practical as it is easily transportable, easy to use, will not damage the putting surface, may be used on a variety of indoor and outdoor putting surfaces, and will not need to be reassembled each time the golfer desires to putt from a different position from the golf hole. Further, the present invention does not provide simulated training, but utilizes the golfer's real golf club, golf balls, and golf hole; the present invention may be used at real putting greens to provide realistic instruction so the golfer can develop an accurate "feel" of a proper putt. Accordingly, the present invention provides a practical and effective method to train a golfer to properly putt while providing versatility and addressing the drawbacks in the art. It is to be understood that, although some advantages of the present invention are described herein, it is not necessary that all the advantageous features and/or all the advantages need to be incorporated into every embodiment of the invention.

To achieve the foregoing and in accordance with the purposes of the present invention, the present invention is directed to a golf putting device that generally comprises: (a) a rotating head that includes a retractable line, a clip that attaches the retractable line to a golf club, and a first connecting member; and (b) a base comprised of a second connecting member located on top of the base wherein the rotating head is attached to the base by engaging the first connecting member onto the second connecting member and the rotating head rotates on the second connecting member. The base may be adapted to fit inside a standard golf hole, and the golf putting device may further comprise a plurality of legs attached to the base. For example, in one embodiment, the plurality equals at least three and the legs are detachable from the base.

In certain embodiments of the invention, the rotating head further comprises a housing that encloses the retractable line, the housing comprising an aperture through which the retractable line passes through. The housing may further include a cup-shaped first housing component and a cup-shaped second housing component. The first housing component includes a first depression on the rim of the first housing component, a first set of links along the interior lateral side of the first housing component, and an annular structure at the interior centerpoint of the first housing component. The second housing component includes a second depression on the rim of the second housing component, a second set of links along the interior lateral side of the second housing component, and a stem at the interior centerpoint of the second housing component. The first connecting member of the rotating head is located on the exterior centerpoint of the cup-shaped second housing component. The first depression is coupled with the second depression to form the aperture and the first set of links is adjoined with the second set of links to connect the first housing component with the second housing component. The first set of links and the second set of links each have equal number of links (e.g., each set may include four links) and the links may be comprised of hollow shafts through which screws may be inserted into. Additionally, the housing may further comprise a top shell that is attached to the first housing component and a bottom shell that is attached to the second housing component, and the bottom shell includes a hole through which the first connecting member runs through.

The retractable line of the present invention is wrapped around a spool comprising a first casing element and a second casing element which includes a spring wound on an arbor. The retractable line system used in the present invention may incorporate any suitable power spring or clock spring system known in the art and the spool may vary in structure. The spool is supported in the rotating head's housing via the annular structure and the stem.

The above description sets forth a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in further detail, it is to be understood that the invention is not limited in its application to the details of the construction and to the arrangement of the components set forth in the following description or as illustrated in the drawings. The invention is capable of other embodiments and of being practiced and carried out in various ways. Furthermore, it is to be understood that the phraseology and terminology employed herein are for the purpose of description and should not be regarded as limiting.

Other features, aspects, and advantages of the present invention will become apparent from the following description of the invention, taken in conjunction with the accompanying drawings, which illustrate, by way of example, various features of embodiments of the invention.

DESCRIPTION OF THE INVENTION

In the following description of embodiments of the invention, reference is made to the accompanying drawings, which form a part of this application. The drawings show, by way of illustration, certain embodiments in which the invention may be practiced. It is to be understood that other embodiments may be utilized and modifications may be made without departing from the scope of the present invention. Also, it is to be understood that the phraseology and terminology employed herein are for the purpose of description and should not be regarded as limiting.

Golf Putting Device

Figure 1:
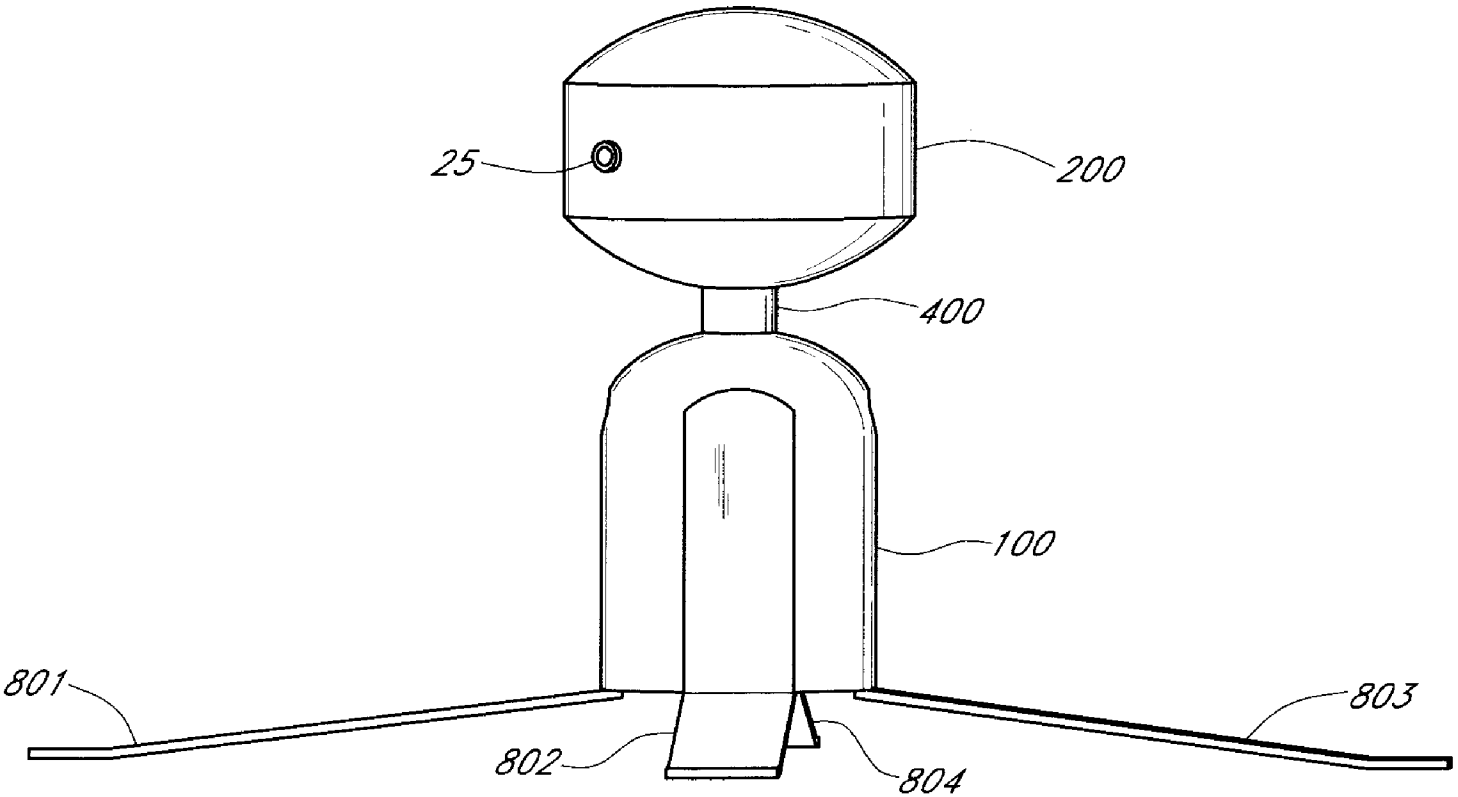
FIG. 1 depicts a perspective view of a golf putting device in accordance with an embodiment of the present invention.
Figure 2:
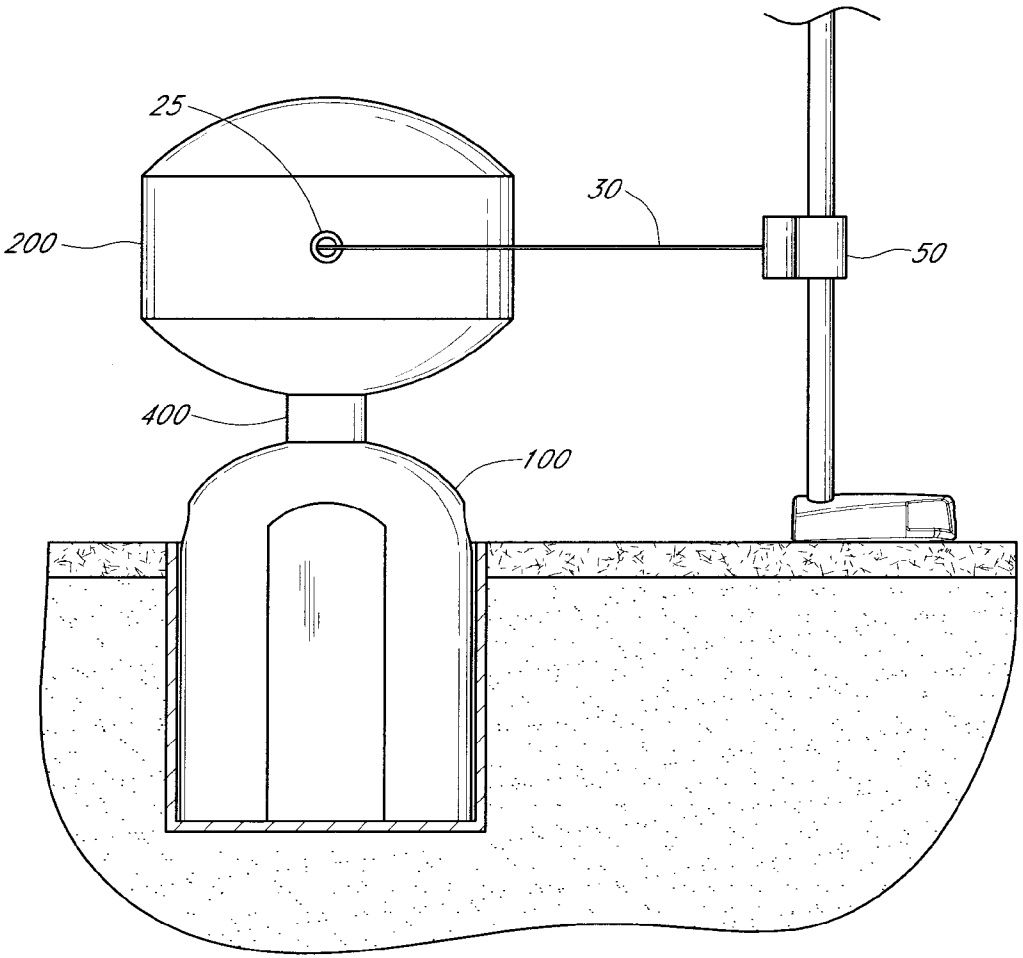
FIG. 2 depicts a golf putting device inserted in a golf hole in accordance with an embodiment of the present invention.

A seen in FIGS. 1 and 2, the golf putting device of the present invention comprises rotating head 200 connected to base 100 by first connecting member 400. In the embodiment of the invention shown in FIG. 2, the golf putting device is comprised of (a) rotating head 200 which includes retractable line 30, clip 50 that attaches retractable line 30 to a golf club, and first connecting member 400; and (b) base 100 which is adapted to fit inside a standard golf hole. Rotating member may also be comprised of a housing that encloses retractable line 30. The housing includes aperture 25 through which retractable line 30 passes through as seen in FIGS. 1 and 2.

A user would utilize the present invention illustrated in FIG. 2 by inserting base 100 into a golf hole; selecting a putting angle position by revolving rotating member 200; selecting a putting distance by extracting and/or retracting retractable line 30 from rotating member 200; attaching clip 30 to a golf club; and executing a putting stroke from the selected putting angle and putting distance. During this process, the user allows tension in the retractable line to train the user's muscles to understand the force necessary to control the pace of the putter, as well as to operate on the proper parallel swing path in both the backswing and the downswing.

As depicted in FIG. 1, the golf putting device may further comprise a plurality of legs attached to base 100. Such embodiments allow the invention to be used for off-hole use (i.e., home or office use on a flat surface with no pre-existing holes). As exemplified in FIG. 1, the plurality of legs may be comprised of first leg 801, second leg 802, third leg 803, and fourth leg 804. Legs 801, 802, 803, and 804 are detachable from base 100 to allow both golf course and off-hole use and for ease of transport. Although four legs are illustrated in FIG. 1, the putting device may also comprise three legs and still provide ample support for the putting device. Thus, the plurality of legs may equal at least three legs.

Rotating Head

Figure 3:
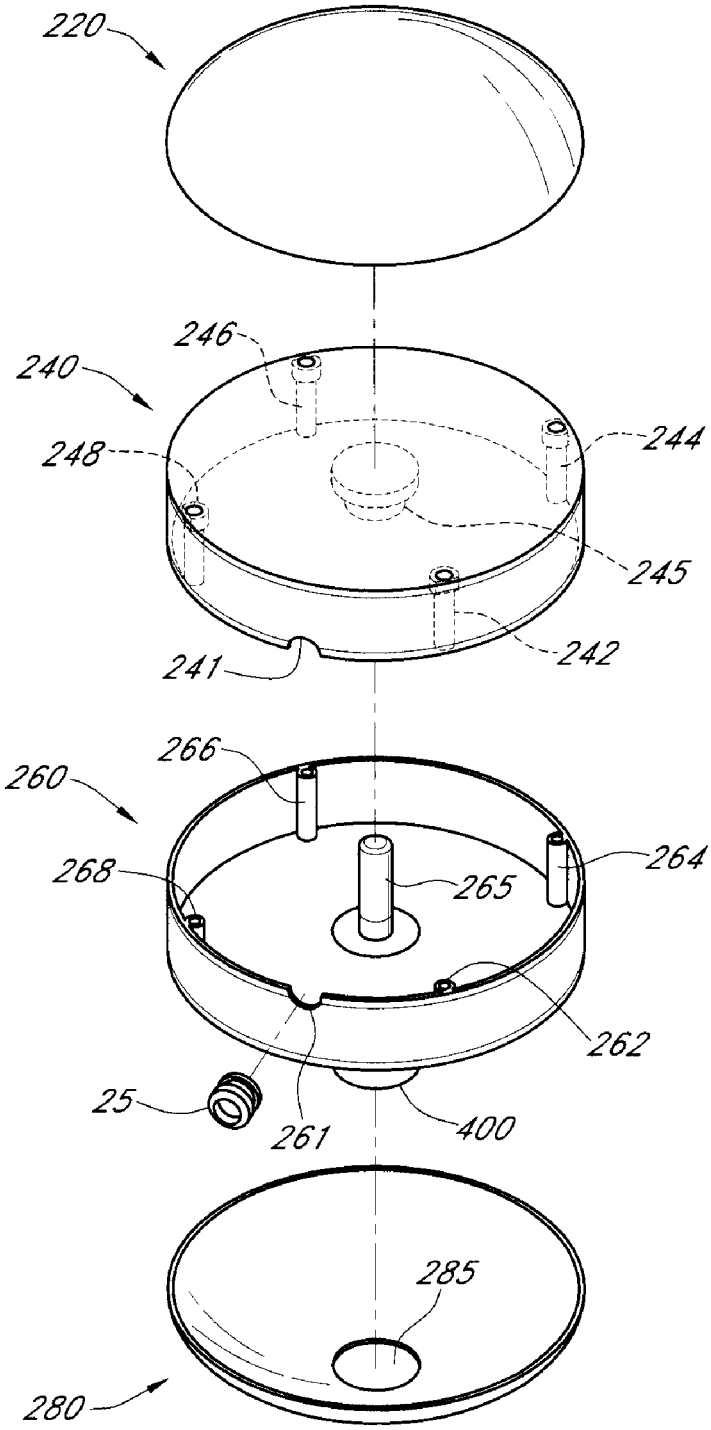
FIG. 3 depicts an exploded view of the rotating head of a golf putting device in accordance with an embodiment of the present invention.

FIG. 3 illustrates an exploded view of rotating member 200. As mentioned above, the rotating head may comprise of a housing that encloses retractable line 30 wherein the housing includes aperture 25 through which retractable line 30 passes through. In the illustration shown in FIG. 3, the housing that encloses retractable line 30 is comprised of first housing component 240 and second housing component 260. Both first housing component 240 and second housing component 260 are cup-shaped, each having a rim, an interior lateral side, an exterior lateral side, an interior centerpoint, and an exterior centerpoint. The interior lateral side would be the sides of the inside of the cup and the exterior lateral side would be the outer lateral side of the cup. The interior centerpoint would be the centerpoint of the circular bottom of the interior of the cup, and the exterior centerpoint would be the centerpoint of the circular bottom of the outside of the cup.

First housing component 240 includes: first depression 241 on the rim of first housing component 240, a first set of links along the interior lateral side of first housing component 240, and annular structure 245 at the interior centerpoint of first housing component 240. The first set of links is comprised of links 242, 244, 246, and 248. Second housing component 260 includes: second depression 261 on the rim of second housing component 260, a second set of links along the interior lateral side of second housing component 260, and stem 265 at the interior centerpoint of second housing component 260. First connecting member 400 is located on the exterior centerpoint of the cup-shaped second housing component 260. The second set of links is comprised of links 262, 264, 266, and 268.

Links 242, 244, 246, and 248 is adjoined respectively with links 262, 264, 266, and 268 to connect the first housing component 240 to second housing component 260. Thus, link 242 adjoins with link 262, link 244 adjoins with link 264, link 246 adjoins with link 266, and link 248 adjoins with 268. The links shown in FIG. 3 are comprised of hollow shafts through which screws, pins, or similar structures may be inserted to secure and connect first housing component 240 with second housing component 260. Thus, links of first housing component 240 are aligned to the corresponding links of second housing component 260 and a screw, pin, or similar structure is inserted in each channel formed by each pair of links. For example, link 242 aligns with link 262 to form a channel though which a screw may be inserted therein, link 244 aligns with link 264 to form a channel though which a screw may be inserted therein, and so on. In alternate embodiments, the links may not require a screw, pin, or similar structure to be adjoined to one another and may be comprised of other suitable connecting structures such as snapping structures that snap to one another (e.g., those that have male and female structures) or any other structure that may be inter-engaged to one another and locked into place.

Although each set of links is comprised of four links each, it is not necessary that each set have four links so long as the number of links in each set are equal so they can properly engage with one another and so long as the number of links provides sufficient support to hold first housing component 240 with second housing component 260. Thus, there should be a plurality of links to provide ample support.

When engaging first housing component 240 with second housing component 260, first depression 241 is coupled with second depression 261 to form aperture 25. FIG. 3 depicts a ring structure that may surround and form part of aperture 25. However, aperture 25 may simply be the opening with no additional ring like structure surrounding and lining the opening. A ring like structure is not a necessary element of the present invention but may provide less resistance or friction when retractable line 30 passes through aperture 25.

Annular structure 245 and stem 265 are aligned to support and hold the retractable line spool (see FIG. 6) while providing a rotational axis upon which the spool can spin to allow for extension and retraction of the retractable line. Annular structure 245 and stem 265 may vary in shape, dimension, and structure depending on the spool it is to accommodate. For instance, annular structure 245 is comprised of an annular projection which engages with a depression on one end of the outer casing of a spool while stem 265 in inserted through the opening of the opposite end of the spool.

Additionally, the rotating member shown in FIG. 3 may further include top shell 220 that is attached to first housing component 240 and bottom shell 280 that is attached to second housing component 260. Bottom shell 280 includes a hole 285 through which first connecting member 400 runs through. The top shell 220 and bottom shell 280 shown in FIG. 3 are lens-shaped with a slight curvature. However, in alternate embodiments, top shell 220 and bottom shell 280 may be comprised of any shape (e.g., they may be shaped with an increased curvature so that it resembles a golf ball when assembled with first housing component 240 and second housing component 260). Yet in other embodiments, the rotating member does not include top shell 220 and bottom shell 280, and the retractable line would merely be enclosed by first housing component 240 and second housing component 260. In even more basic versions of the invention, rotating member would not include a housing to enclose the retractable line and the retractable line and spool would be exposed.

Rotating head 200 depicted in FIGS. 1-3 is cylindrical in structure; however, any suitable variation in dimensions and shape are possible so long as it can accommodate retractable line 30's power spring system which is housed therein. For instance, rotating head 200 may be spherical in shape and in certain embodiments, rotating head 200 may be shaped to resemble a golf ball as mentioned above.

Rotating head 200 rotates 360 degrees in either direction (clockwise or counter-clockwise) about the axis formed by first connecting member 400 and second connecting member 410 located on the top of base 100 (see FIG. 4) thereby allowing the golfer to putt from any angle with respect to a golf hole and from any position on the putting green (limited only by the length of retractable line 30).

Base

Figure 4:
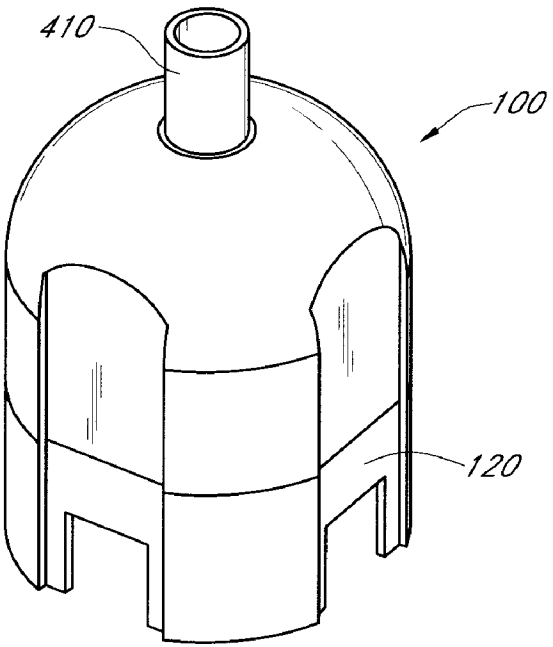
FIG. 4 depicts a perspective view of the base of a golf putting device in accordance with an embodiment of the present invention.

FIG. 4 depicts base 100 which includes second connecting member 410 located on top of base 100 and may further include leg attachment point 120 for embodiments of the invention which include detachable legs. Rotating head 200 is attached to base 100 by engaging first connecting member 400 that is hollow and cylindrical in shape onto second connecting member 410 that is cylindrical in shape and adapted to receive first member 400. Rotating head 200 rotates on second connecting member 410. Thus, second connecting member 410 forms the axis upon which rotating head 200 rotates whereby first connecting member 400 rotates on fixed second connecting member 410.

Second connecting member 410 essentially acts as the female structure to accept first connecting member 400 which acts as the male structure. This connecting system allows rotating head 200 to completely rotate 360 degrees on second connecting member 410. In other variations of the invention, first connecting member 400 may act as the male structure and second connecting member 410 may act as the female structure and may be positioned on top of base 100 or recessed within base 100. Yet in other embodiments, first connecting member 400 and second connecting member 410 may each include both male and female type structures (e.g., each may include both an annular projection and annular depression) wherein first connecting member 400 and second connecting member 410 inter-engage with one another while still allowing rotation of rotating head 200.

In the embodiment of the invention depicted in FIG. 4, base 100 is specially adapted to fit in a golf hole to stably hold the putting device of the present invention upright. Base 100 is sufficient to stably hold the putting device upright and within the golf hole. Additionally, base 100 may be adapted to fit into a putting cup for the home or office.

In alternate embodiments of the invention, base 100 may be designed in a way that it comprises a hollow cylindrical ring that rests inside the golf hole without extending over the top of the hole (i.e., the level of the putting surface). In such embodiments, base 10 does not get in the way of the golf ball, and allows for the golf ball to actually be putted into the golf hole.

Legs

In further embodiments of the invention, base 100 may be designed like a stand that includes a plurality of legs radiating outward from the axis formed by base 100. Such embodiments of the invention may be used in a variety of outdoor and indoor locations such as with home and office putting cup systems or no putting cup system is required at all. FIG. 1 illustrates an embodiment of the invention wherein the putting device comprises detachable legs 801, 802, 803, and 804. The device may be used for off-hole locations such as at indoor locations, or the legs 801, 802, 803, and 804.

Figure 5:
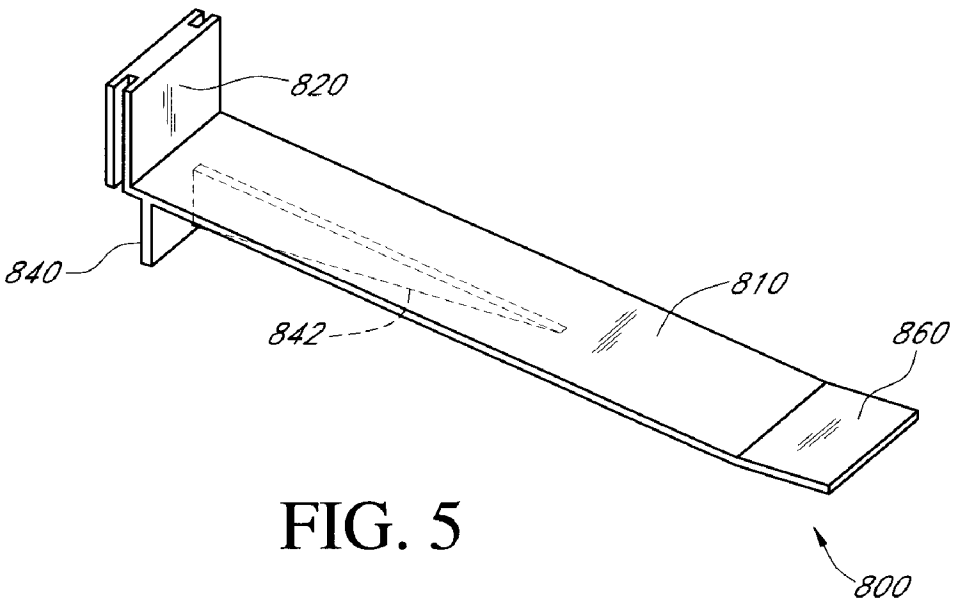
FIG. 5 depicts a perspective view of a detachable leg of a golf putting device in accordance with an embodiment of the present invention.

FIG. 5 illustrates a leg 800 that may be used in accordance with an embodiment of the invention which includes detachable legs. Leg 800 includes leg body 810 which runs the length of the leg, leg attachment 820 which attaches to leg attachment point 120 of base 100 (see FIG. 4), leg support 840, and leg end 860 which is the surface which makes contact with the ground. Leg 800 may further include optional leg support 842 which is a fin-like structure that supports leg body 810. Leg attachment 820 may be comprise any suitable structure that is adapted to inter-engage with the slot of leg attachment point 120 of base 100. A suitable structure for leg attachment 820 would permit leg 800 to be held stably in place while at the same time allows easy removal of leg 800. For example, the leg attachment may include a clip-like structure, a structure that slides onto base 100, a snapping structure that snaps into place, etc.

The legs may be positioned over the golf hole or areas designated as a golf hole for off-hole use and serve as a support system much like a tree-stand or tripod to stably hold the putting device upright. Such embodiments of the invention may expose the opening of the golf hole to allow the user to actually practice putting the golf ball into the golf hole, and in other embodiments each of the legs can be adjusted to provide further support on uneven putting surfaces. Furthermore, instead of the leg structures being detachable, the legs may also be attached with a hinge to base 100, folded, or collapsible for ease of transport.

Retractable Line

Figure 6:
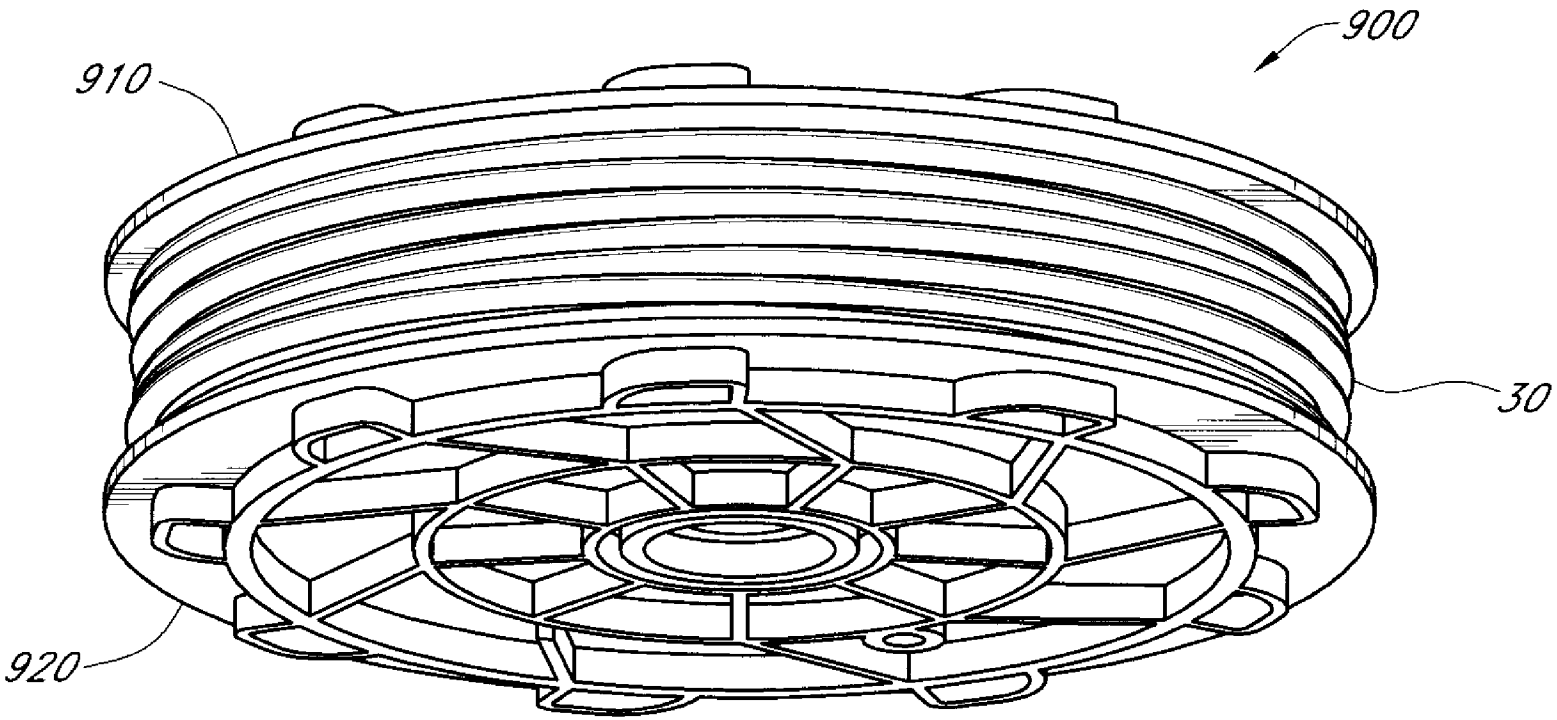
FIG. 6 depicts a perspective view of the retractable line wrapped around a spool of a golf putting device in accordance with an embodiment of the present invention.
Figure 7:
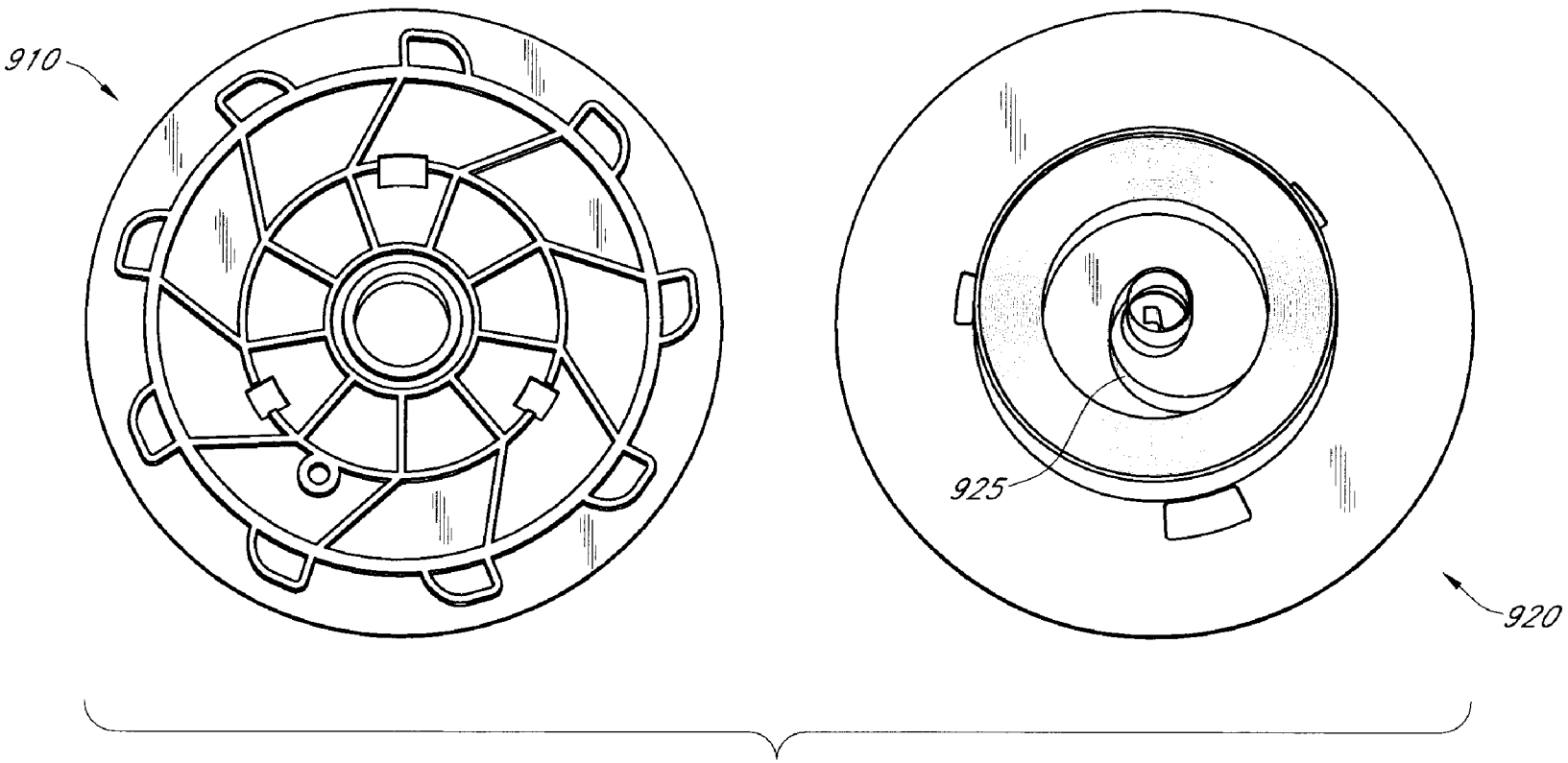
FIG. 7 depicts components of a spool of a golf putting device in accordance with an embodiment of the present invention.

FIG. 6 depicts retractable line 30 wrapped around spool 900 in accordance with an embodiment of the present invention. Spool 900 is comprised of first casing element 910 and second casing element 920. FIG. 7 depicts an exterior view of first casing element 910 and an interior view of second casing element 920 which includes a spring 925 wound on an arbor. Spool 900 is supported in rotating head 200 via annular structure 245 of first housing component 240 and stem 265 of second housing component 260 as discussed above (see FIG. 3).

Retractable line 30 may utilize any suitable power spring or clock spring system known in the art. Such power spring systems are commonly used in tape measurers, cord retractors, and retractable dog leashes. Power spring systems permit retractable line 30 to be retracted in and out of rotating head 200. Any suitable spring system known in the art that permits retraction and extraction of retractable line 30 while providing tension in retractable line 30 may be used in the present invention. For instance, power springs (also referred to as clock springs, torsion springs, and hair springs) exert momentum and torque. Within a power spring, the main two elements that allow the momentum and torque are through both the line reel retraction and the torsional counterbalancing.

Retractable line 30 may be mechanically spun around an arbor. This spring system may be housed inside of a case or retaining ring for further concealment and protection. In the present invention, retractable line 30 and spool 900 is essentially housed in a separate housing (comprised of first housing component 240 and second housing component 260) in rotating head 200. In certain embodiments, the power springs may be pre-stressed. By having these pre-stressed power strings, every cylindrical rotation produces a flatter torque gradient than a conventional power spring. A flatter torque gradient means, for the user, an increase in the amount of turns for a given case diameter.

The power spring system used in the present invention should provide sufficient tension in retractable line 30 to train the golfer to putt as more fully described below. In some embodiments of the present invention, the amount of tension in retractable line 30 may be adjusted by the user to accommodate the user's preferences or needs. In alternate embodiments of the invention, the tension in retractable line 30 may be adjusted to accommodate particular users (e.g., children, elderly users, etc.). Retractable line 30 may be comprised of a variety of materials and lengths. For instance, retractable line 30 may be comprised of a braided/twisted nylon or steel material, a slightly elastic rubber compound, plastic cable, or any other material known to those skilled in the art. Also, retractable line 30 may be of any suitable length; however, longer lengths (without comprising tension and retractability) will provide the most variation in putting distances from which the golfer may putt from. For example, in one embodiment, retractable line 30 may extend 25 feet.

Alternate Embodiment

Figure 8:
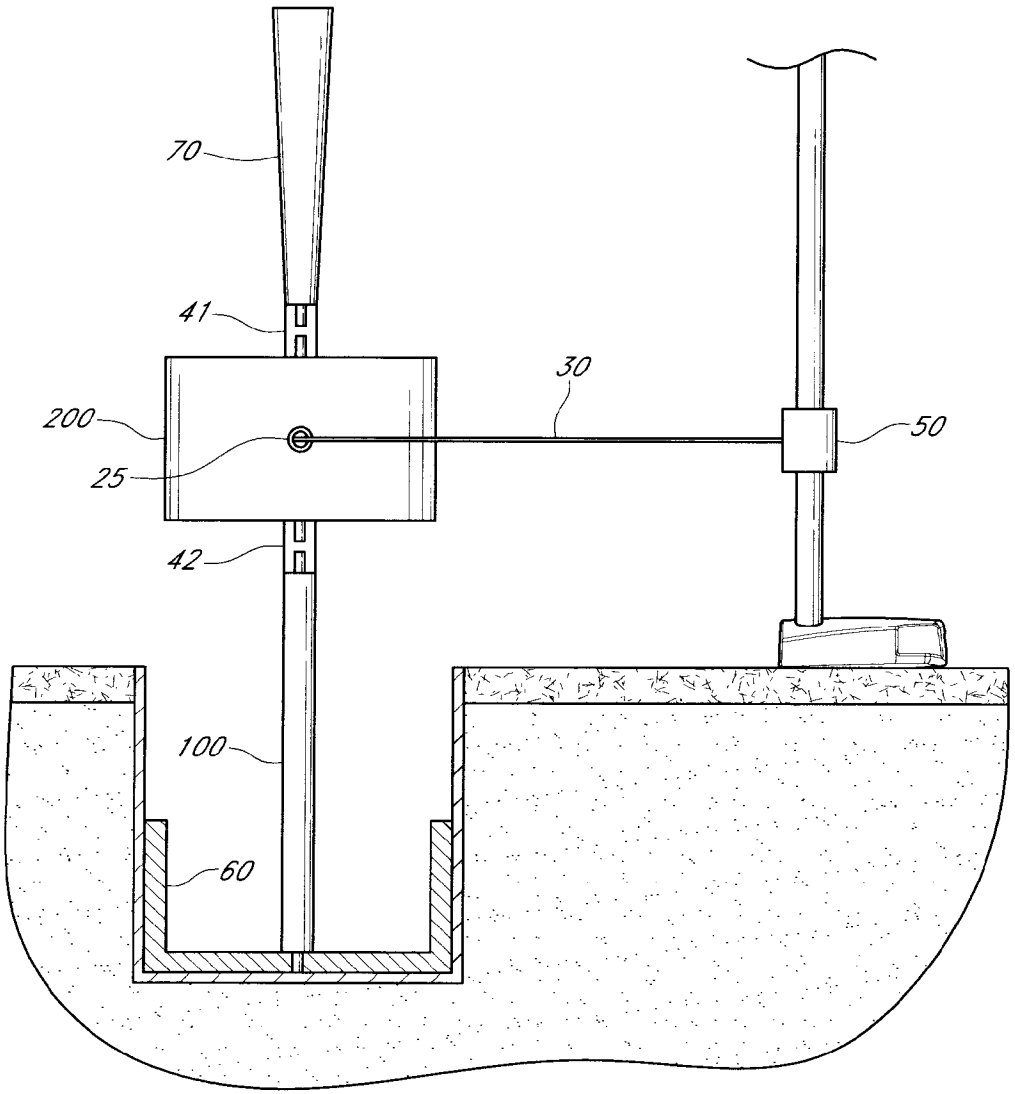
FIG. 8 depicts a golf putting device inserted in a golf hole in accordance with an embodiment of the present invention.

FIG. 8 illustrates an alternate embodiment of the present invention that comprises base 100 that is inserted into a golf hole/cup; rotating head 200 that houses retractable line 30 therein; aperture 25 in rotating head 200 through which retractable line 30 runs through; a first connector 41 and a second connector 42 that connect rotating head 200 to base 100; and a clip 50 or other attachment device that attaches retractable line 30 to a golf club. In the embodiment depicted in FIG. 8, base 100 further comprises cup liner 60 that is inserted into a golf hole to stabilize the putting device of the present invention and handle 70 which lies on top of rotating head 200.

Rotating head 200 may be affixed to base 100 by any variety of suitable methods known to those skilled in the art. For instance, in FIG. 1, first connector 41 and second connector 42 secure rotating head 200 onto base 100 while still allowing rotating head 200 to completely rotate on the axis formed by base 100. In one embodiment of the invention, first and second connectors 41 and 42 may be annular (or any suitable shape) so that it can be placed on and securely fastened onto base 10 by any suitable locking mechanism known in the art. Such annular-shaped connectors allow rotating head 200 to rotate on base 100. Alternatively, first and second connectors 41 and 42 may be manufactured as part of base 100 such that base 100 is comprised of a first component with first connector 41 permanently affixed thereto, and a second component with second connector 42 permanently affixed thereto. In this embodiment, first and second connectors of base 100 securely inter-engage with one another with rotating head 200 positioned in-between first and second connectors 41 and 42, wherein first and second connectors 41 and 42 form an axis upon which rotating head 200 spins on. The first and second connectors may either permanently inter-engage with one another, or in portable variations of the invention, first and second connectors 41 and 42 may removeably inter-engage with one another wherein the user may disengage first and second connectors 41 and 42 from each other for ease of transport.

Base 100 may be of any suitable shape and dimensions and made of any suitable materials. In the embodiment depicted in FIG. 1, base 100 has a pole-like structure and is comprised of a rigid material such as metal or hard plastic so that it stably holds the invention in place. Base 100 includes a cup-liner 60 attached thereto to stably hold the device upright and secure the device within the golf hole. In the embodiment depicted in FIG. 1, cup liner 60 may be comprised of any suitable shape or dimension and may further include any variety of structures to keep the putting device secure within the golf hole. For example, in one embodiment, cup liner 60 may be comprised of a plurality of ribs (or spoke-like structures) that extend radially from the axis formed by base 100. Such ribs may be of any suitable dimensions and may be comprised of any suitable material (e.g., metal, rigid plastic, fiberglass, or any combination thereof) that is rigid enough to support the putting device within the golf hole. Yet, in a further embodiment, cup liner 60 may be comprised of one solid cylindrical structure (without multiple components or ribs) that fits snugly into a standard-sized golf hole. The embodiments of the invention that include cup liner 60 offer the user the advantage of allowing the user to actually practice putting the ball into the golf hole (as opposed to embodiments of the invention that do not expose the golf hole). In another embodiment of the invention, base 100 may further include an apparatus at the bottom end that can be inserted into the hole of the plastic lining/cup that lines the interior of golf holes (the smaller hole at the bottom of the golf hole into which the flag pin is normally inserted), which can work together with cup liner 60 to further secure the putting device of the present invention within the golf hole.

Golf Club Attachment

Clip 50 attaches retractable line 30 to the user's golf club. Alternatively, the method of attaching the retractable line to the golf club may employ any suitable method of attachment known in the art. For example, in one embodiment, clip 50 is comprised of a clip-type or clamp-type structure which simply clips or clamps securely onto a golf club. Clip 50 may further include a locking mechanism to further secure retractable line 30 to a golf club. In alternate embodiments, the golf club attachment may be comprised of an elastic ring structure that simply slips onto a golf club and is made of a material of sufficient friction (such as rubber) that it will resist slipping or moving up or down the golf shaft. In such embodiments of the invention, the ring is securely and stably attached to the golf club, and the elastic material used does not interfere with the user's swing.

Handle

Still referring to FIG. 8, handle 70 is certainly not limited to a particular size or shape. Handle 70 may be designed to contour a user's hand any may further include a non-slip element for ease of gripping. For example, a non-slip element such as a rubber coating may be applied to the surface of handle 70. The non-slip element (e.g., rubber material) provides sufficient frictional properties that would allow the user to easily grip the putting device. Handle 70 may also comprise of a vertical ring that may be grasped by the user. In alternate embodiments, handle 70 may resemble the flags used in traditional golf clubs, and the flags may be emblazoned with varying or user-customizable words, initials, or designs.

Additionally, a non-slip element such as a rubber coating may also be applied to the surface of clip 50 that engages with the golf club to further secure clip 50 in place. Also, in alternate embodiments of the invention, the surfaces of cup liner 60 and/or base 100 that engage with the golf hole may also be lined with a non-slip element to further stabilize the device within the golf hole.

Although the non-slip element is preferably a rubber material, it will be readily appreciated to those skilled in the art that the non-slip element may be composed of a variety of elements such as any polymer compound exhibiting a relatively high coefficient of friction. The non-slip element has a coefficient of friction that provides sufficient frictional force to provide resistance to movement of the putting device of the present invention. Examples of materials that may be used for the non-slip element may include, but are not limited to, natural rubber, synthetic rubber, latex rubber, plastic material that is tacky, and combinations thereof.

EXAMPLES

In the foregoing description of embodiments of the invention, reference was made to the accompanying figures, which form a part of this application. The figures show, by way of illustration, certain embodiments in which the invention may be practiced. It is to be understood that other variations are possible and modifications may be made without departing from the scope of the present invention. A variety of embodiments are possible wherein each embodiment includes a different combination of the different aspects and elements of the present invention.

For example, in one embodiment, the golf putting device comprises: (a) a rotating head which includes a retractable line, a clip that attaches the retractable line to a golf club, and a first connecting member; and (b) a base comprised of a second connecting member located on top of the base. The rotating head is attached to the base by engaging the first connecting member onto the second connecting member, and the rotating head rotates on the second connecting member.

In another example, an alternate embodiment of the invention may include: (a) a rotating head comprised of (i) a retractable line, (ii) a clip that attaches the retractable line to a golf club, (iii) a housing that encloses the retractable line and includes an aperture through which the retractable line runs through, and (iv) a first connecting member; (b) a base that is adapted to fit inside a golf hole; and (c) a plurality of legs attached to the base. The rotating head is attached to the base by engaging the first connecting member onto a second connecting member positioned on top of the base, and the rotating head rotates on the second connecting member. In a variation of this embodiment, the legs are detachable from the base.

In a further example, the golf putting device is comprised of: (a) a rotating head that includes (i) a retractable line, (ii) a clip that attaches the retractable line to a golf club, (iii) a housing that encloses the retractable line, and (iv) a first connecting member located on the exterior centerpoint of the second housing component of the housing; and (b) a base adapted to fit inside a golf hole. The base includes a second connecting member located on top of the base wherein the rotating head is attached to the base by engaging the first connecting member onto the second connecting member, and the rotating head rotates on the second connecting member. The housing that encloses the retractable line is comprised of: (i) a cup-shaped first housing component that includes a first depression on the rim of the first housing component, a first set of links along the interior lateral side of the first housing component, and an annular structure at the interior centerpoint of the first housing component; and (ii) a cup-shaped second housing component that includes a second depression on the rim of the second housing component, a second set of links along the interior lateral side of the second housing component, and a stem at the interior centerpoint of the second housing component. The first set of links and the second set of links each comprise of an equal number of links. The first depression is coupled with the second depression to form an aperture through which the retractable line runs through, and the first set of links is adjoined with the second set of links to connect the first housing component to the second housing component. In one variation, the golf putting device further includes at least three legs attached to the base wherein the legs are removable. In another variation, the first set of links and the second set of links are comprised of hallow shafts through which screws may be inserted. The retractable line is wrapped around a spool supported by the annular structure and the stem, the spool comprising a first casing element and a second casing element including a spring wound on an arbor.

Method of Putting Training

With respect to the method of the present invention, the order in which the actions are presented below is not limited to any particular order and does not necessarily imply that they have to be performed or occur in the order presented. It will be understood by those of ordinary skill in the art that the order of these actions can be rearranged and performed in any suitable manner. It further will be understood by those of ordinary skill in the art that some actions may be omitted, added, and/or modified and still fall within the spirit of the invention.

Another aspect of the present invention is directed to a method of training a golfer to control the distance the golf ball travels by training the golfer's muscles to understand the required force needed to control the pace of the putting swing and the proper acceleration through the golf ball on a particular surface. The present invention trains the golfer to strike a ball with a consistent amount of force by using a consistent swing speed and rate of acceleration through the ball. Not only does the present invention impart proper muscle memory by providing tactile feedback that teaches the golfer the proper swing speed and rate of acceleration, the present invention also teaches direction by "guiding" the putter into the proper swing path. Moreover, since the putting device of the present invention is versatile and permits putting from a variety of positions, the golfer may learn how to putt from any angle around a golf hole since the putting device rotates 360 degrees, and the golfer may learn how to putt from a variety of distances from the golf hole via the retractable line.

The present invention is also directed to a method of training a golfer to putt, the method comprising: (a) providing a golf putting device that includes a base, a rotating head with a retractable line therein, an aperture in the rotating head through which the retractable line runs, one or more connecting members that connect the rotating head to the base, and a clip that attaches the retractable line to a golf club; (b) inserting the base into the golf hole; (c) selecting a putting angle position by revolving the rotating head; (d) selecting a putting distance by extracting and retracting the retractable line from the rotating head; (e) attaching the clip to a golf club; and (f) executing a putting stroke from the selected putting angle and putting distance. During this process, the tension in the retractable line helps train the golfer's muscles to understand the force necessary to control the pace of the putter, and thus the golf ball. In alternate embodiments of the invention, the method may further comprise attaching a plurality of legs to the base and positioning the base over a golf hole or area designated as a golf hole instead of inserting the base into a golf hole as listed in action "(b)" above.

In the foregoing method of the present invention, the user uses a golf putting device as described hereinabove. Referring to FIG.8, the user inserts cup liner 60 of base 100 into a golf hole/cup. However, in alternate embodiments, base 100 may be specially adapted to be inserted into a golf hole, and therefore, this component of the method of the present invention may be modified accordingly. In the embodiments which include a plurality of detachable legs radiating from base 10, instead of placing the device inside a golf hole/cup, the device is placed either (a) above the golf hole/cup, or (b) over any suitable surface so the user may use the device for off-hole use such as at the home or office.

The user selects a putting angle position by revolving rotating head 200. Rotating head 200 is revolved simply by the user walking toward the desired putting position, while holding retractable line 30 or with retractable line 30 attached to his putter. Rotating head 200 can freely rotate (throughout all 360 degrees of movement) about the axis formed by second connecting member 410 in either direction (clockwise or counter-clockwise), and the user can therefore practice putting from any angle. The user also selects a putting distance from which to putt by extracting and retracting retractable line 30. The user attaches the retractable line 30 by attaching clip 50 to his/her golf club via clip 50. In the preferred embodiment, selecting an angle and distance is as simple as attaching the device to a golf club and walking to the desired position with the golf club.

After the above actions are completed, the user may then execute a putting stroke from the selected putting angle and putting distance. The user allows the tension in retractable line 30 to train the user's muscles to understand the force necessary to control the pace of the golf ball. The method of the present invention teaches the user how to swing the putter forward in such a manner so that the user develops a better "feel" or distance control of the golf ball. The method (as well as the golf putting device) of the present invention teaches the user how to consistently putt the golf ball the desired distance. By utilizing the golf putting device and method of the present invention, the user develops muscle memory with a constant rate of acceleration on the forward movement of the putter. The user makes a backstroke using the tension from retractable line 30, thus controlling the backstroke or "pull back." At the desired backstroke length, the spring system recoils and retracts retractable line 30 thereby pulling the putter back towards the cup or hole while creating a well-paced follow through. The tension of retractable line 30 helps pull the putter forward at the desired speed, giving the golfer a tactile reminder of the importance of the follow-through. In this manner, improper "poking" or "stabbing" at the golf ball (i.e., abruptly decelerating the putter once it strikes the golf ball) is discouraged, and the proper stroke , acceleration through the golf ball, and follow-through is encouraged and imparted into muscle memory. During this process, due to the spring system's recoiling of retractable line 30, the user's stroke will also be aligned directly away from the hole or cup on the backswing, and then directly toward the direction of the hole or cup on the downswing, simultaneously training the user to also aim toward the intended target by keeping his complete swing on the proper swing path.

Due to the versatility of the device, if the user misses the golf hole, the user does not have to re-assemble the device of the present invention. Instead, the user just re-selects a putting angle position via rotating head 200, reselects a putting distance from which to putt via retractable line 30, and executes a putting stroke. (This process is as simple as bringing the putter over to where the ball has rested—just as a golfer would do if he missed a putt on a golf course. Rotating head 200 and retractable line 30 will adjust to the proper line and distance.) When the user succeeds in putting the ball into the golf hole/cup, the user can then re-putt from the same putting angle position and putting distance to train his/her muscles to understand the required force needed to control the pace and distance of the golf ball.

Further Embodiments

Although the present invention has been described above in considerable detail with reference to certain versions thereof, other versions are possible. As discussed above, many of the structural components of the invention (e.g., base, rotating head, connecting members, clip, and handle) may be of any suitable shape, size, and/or configuration; may further include structures not described hereinabove; and may be positioned at alternate suitable locations within the device without departing from the spirit and scope of the present invention.

The attached figures depicting various embodiments of the invention are primarily intended to convey the basic principles embodied in the present invention. Thus, the present invention may further include additional structures and features including aesthetically pleasing features such as various finishes, coatings, paint colors and designs, or designate a particular application for which the present invention is being used (e.g., include personal, school, company name, or golf course name indicia), or may be customized for any variety of users.

The application of the present invention is not limited to putting. Alternate embodiments of the present invention could also be adapted for use with other golf clubs and types of shots; for example, an alternate embodiment of the invention could use a different amount of tension and a longer retractable line for use with various golf clubs used in "chipping." Chipping is performed when the golf ball is near, but not on, the putting green, and uses a measured stroke of limited backswing (just like putting) wherein speed control and distance are far more important than maximum speed, power, and distance. Golfers may chip with various golf clubs, including pitching wedges, lob wedges, gap wedges, sand wedges, 9-irons, 8-irons, 7-irons, or 6-irons.

Additionally, alternate embodiments of the present invention may be designed for full iron shots, wood shots, or drives (with the driver). Such embodiments would use varying degrees of tension and lengths of the retractable cord in order to impart the proper swing speed and path. In various embodiments, the base itself could also be modified to be placed on a flat or grassy surface other than a putting hole; for example, instead of using detachable legs, alternate embodiments could use a stake, tripod, weights, or other structures instead to secure the present invention in the absence of a golf hole.

Further, the device of the present invention may have a variety of other applications and is not limited to golf applications. For instance, different embodiments of the invention may train a user's muscles to throw a javelin correctly, to throw or kick a football, to shoot a basketball, to kick a soccer ball, to throw a Frisbee or other flying disc, to shoot a ball into a pocket in billiard applications, to swing a baseball or softball bat at the proper angle and speed, to perform certain dance or acrobatic moves, to bowl correctly, and many other possible athletic applications that involve the use of muscle memory.

Additionally, some of the actions or steps for training a golfer to putt as described in the method hereinabove may be added, omitted, modified, or performed in various sequences. Also, some of the actions identified in the embodiments described herein are for illustrative purposes, and as such, some of the actions may be modified, added, or omitted without departing from the scope of the invention.

While the description above refers to particular embodiments of the present invention, it will be understood that many modifications may be made without departing from the spirit thereof. The presently disclosed embodiments are therefore to be considered in all respects as illustrative and not restrictive.

What is claimed is:

1. A golf putting device comprising:

(1) a rotating head comprised of (a) a retractable line, (b) a clip that attaches the retractable line to a golf club, (c) a first connecting member, and (d) a housing that encloses the retractable line, the housing comprising (i) an aperture wherein the retractable line passes through the aperture, (ii) a cup-shaped first housing component comprising a first depression on the rim of the first housing component, a first set of links along the interior lateral side of the first housing component, and an annular structure at the interior centerpoint of the first housing component, (iii) a cup-shaped second housing component comprising a second depression on the rim of the second housing component, a second set of links along the interior lateral side of the second housing component, and a stem at the interior centerpoint of the second housing component wherein the first connecting member is located on the exterior centerpoint of the second housing component, the first depression is coupled with the second depression to form the aperture and the first set of links is adjoined with the second set of links to connect the first housing component with the second housing component, and (iv) a top shell that is attached to the first housing component and a bottom shell that is attached to the second housing component wherein the bottom shell includes a hole wherein the first connecting member runs through the hole; and (2) a base comprised of a second connecting member located on top of the base wherein the rotating head is attached to the base by engaging the first connecting member onto the second connecting member and the rotating head rotates on the second connecting member.

2. A golf putting device comprising:

(1) a rotating head comprised of (a) a retractable line, (b) a clip that attaches the retractable line to a golf club, (c) a first connecting member, and (d) a housing that encloses the retractable line, the housing comprising (i) an aperture wherein the retractable line passes through the aperture, (ii) a cup-shaped first housing component comprising a first depression on the rim of the first housing component, a first set of links along the interior lateral side of the first housing component, and an annular structure at the interior centerpoint of the first housing component, (iii) a cup-shaped second housing component comprising a second depression on the rim of the second housing component, a second set of links along the interior lateral side of the second housing component, and a stem at the interior centerpoint of the second housing component wherein the first connecting member is positioned on the exterior centerpoint of the second housing component, the first depression is coupled with the second depression to form the aperture, and the first set of links is adjoined with the second set of links to connect the first housing component with the second housing component, and (iv) a top shell that is attached to the first housing component and a bottom shell that is attached to the second housing component wherein the bottom shell includes a hole wherein the first connecting member runs through the hole;

(2) a base that is adapted to fit inside a golf hole; and (3) a plurality of legs attached to the base, wherein the rotating head is attached to the base by engaging the first connecting member onto a second connecting member positioned on top of the base and wherein the rotating head rotates on the second connecting member.

* * * * *